United States Patent [19]

Trainor et al.

[11] 3,994,000

[45] Nov. 23, 1976

[54] DEVICE FOR ELECTROSTATOGRAPHIC REPRODUCTION OF AN OPTICAL IMAGE USING A CHARGE STORAGE GRID

[75] Inventors: John W. Trainor, Pittsford, N.Y.; David W. Meltzer, Miami, Fla.

[73] Assignee: Xerox Corporation, Stamford, Conn.

[22] Filed: May 27, 1975

[21] Appl. No.: 581,012

[52] U.S. Cl. ..... 346/160; 346/158

[51] Int. Cl.[2] ..... G03G 5/04; G03G 5/02

[58] Field of Search ..... 346/74 ES, 74 EB, 74 J, 346/74 S, 74 P; 178/6.6 A

[56] References Cited

UNITED STATES PATENTS

| | | | |
|---|---|---|---|
| 3,368,106 | 2/1968 | Berthold | 346/74 P |
| 3,419,888 | 12/1968 | Levy | 346/74 J |
| 3,495,267 | 2/1970 | Brodie | 346/74 P |
| 3,787,876 | 1/1974 | Pressman | 346/74 J |

OTHER PUBLICATIONS

IBM Tech. Disc. Bull., vol.15, No. 2, p. 575; 7/72, Output Control for Ionic Print Head, Re McCurry & C. A. Speicher.

*Primary Examiner*—Jay P. Lucas

[57] ABSTRACT

Apparatus and method for converting an optical image into an electrostatic image replica. A vacuum tube device includes a source of electrons for propagating electrons toward an array of conductors coupling an interior surface of the vacuum tube device with an exterior surface. The accumulation of electrons on the conductor array produces an electrostatic image. The electrostatic image is determined by modulating a diffuse beam of electrons by means of the charge stored on a control grid. The charge stored on the control grid is established by secondary emission of electrons from an insulating material associated with the control grid. The electrons producing the secondary emission from the control grid originate from a photoemissive cathode are produced by the photoemissive cathode in response to an optical image applied to the cathode. The optical image applied to the photoemissive cathode is the image for which an electrostatic replica is desired.

The photo-emissive cathode and the control grid are arranged so that an electron from a region of the photoemissive electrode impinges on an associated region of the control grid. By varying the accelerating potentials between the photo-emissive cathode and the control grid, thereby determining the ratio of emitted electrons to impinging electrons, a negative or a positive charge can be placed on the control grid by electrons from the photo-emissive cathode. Thus, either a positive electrostatic image master or a negative electrostatic image master of the optical image can be stored on the control grid in response to application of the optical image to the photo-emissive cathode.

14 Claims, 4 Drawing Figures

DEVICE FOR ELECTROSTATOGRAPHIC REPRODUCTION OF AN OPTICAL IMAGE USING A CHARGE STORAGE GRID

This invention relates generally to devices for converting optical images to electrostatic images and more particularly to devices which include a control grid for modulating the density of electrons passing through the control grid thereby producing an electrostatic charge determined by the control grid.

It is known in the prior art that a control grid, utilizing a photoconducting surface, can provide modulation of a stream of electrons in such a manner as to amplify a electrostatic image on the photoconductive surface, of U.s. Pat. No. 2,712,607 issued on July 5, 1955 to C. Orlando. In this patent, no convenient method is disclosed by which the electrostatic image found on the photoconducting surface can be changed. Thus, utilizing the disclosed apparatus to provide for reproduction of a multiplicity of documents would involve complicated apparatus or complex and time-consuming manual procedures. In addition, there is no indication of a method by which the disclosed apparatus could provide an output electrostatic image.

It is also known in the prior art to provide a visual display utilizing a photosensitive control grid, upon which an electrostatic image has been applied to modulate electrons produced by secondary emission of U.S. Pat. No. 3,784,831, issued on Jan. 1974 to Reif. The electrons produced by secondary emissive portion are amplified to provide a visual display on a cathode ray screen. However, the use of a plurality of electron multiplicative devices greatly increases the complexity of the apparatus, while severely limiting the resolution. Furthermore, no method of producing a electrostatic image from an optical image is described.

It is also known in the prior art to utilize a cathode ray tube in conjunction with face plate having an array of conductors joining interior surface of the tube with an exterior surface. The impinging electrons cause an electrostatic potential voltage to accumulate on the external surface. The electrostatic charge can be transferred to an associated medium and the image subsequently developed by electrostatographic or other techniques. This class of cathode ray tubes has been described in an article by Crews et al, IRE Transactions of Electron Devices, September, 1961, Pages 406 – 414. However, in order to provide an electrostatic reproduction of an optical image utilizing this device, the information in an optical image must first be converted to appropriate electric signals. The resulting electrical signals modulate the beam of electrons produced by the cathode ray tube striking the target area. The intermediate step of image conversion to electrical signals can be complex, can be prohibitive in expense, and can require an unacceptable time to provide an electrostatic reproduction of an optical image.

It is therefore an object of the present invention to provide improved device for converting an optical image to an electrostatic image.

It is a further object of the present invention to provide a device for converting an optical image to an electrostatic image without converting information representing the optical image into corresponding electrical signals.

It is a further object of the present invention to provide apparatus whereby information contained in an optical image is represented by controllable physical properties of a control grid, the control grid determining an output of electrostatic charge distribution of the apparatus, whereby a multiplicity of electrostatic replicas of the optical image can be transferred from the apparatus to an associated medium before restoration of the physical properties of the control grid is necessary.

It is another object of the present invention to provide apparatus for producing a positive or a negative electrostatic replica of the optical image.

It is a more particular object of the present invention to provide a control grid responsive to impinging electrons to produce an electrostatic charge distribution thereon. The control grid thereafter modulating a beam of electrons to produce, by accumulation of electrons on an array of conductors, a predetermined electrostaic image.

It is yet another object of the present invention to provide a photo-emissive cathode for producing electrons in response to an applied optical image, the electrons producing a master electrostatic replica, determined by the applied optical image, on a control grid as the result of emission of secondary electrons.

It is yet another particular object of the present invention to provide apparatus for producing a distribution of electrons in response to an applied optical image, the electrons striking an insulating portion of a control grid, and producing a stored distribution of charge on the control grid by trapping or by secondary electron emission, the control grid determining the accumulation of electronic charge on an array of conductors.

It is still another object of the present invention to provide a device for producing a plurality of electrostatic copies of an optical image by controlling, by means of a control grid having a master electrostatic replica of the image stored thereon, the distribution of electronic charge on an array of conductors.

The aforementioned and other objects of the present invention are accomplished by a vacuum tube device including a source of electrons and an array of conducting electrodes coupling an interior surface with an exterior surface, a photo-emissive cathode for producing electrons in response to an applied optical image, and a control grid includng an insulating material for storing a master electrostatic replica of the optical image produced by secondary emission of the electrons of the insulating material after impact by the photo-emitted electrons.

The optical image is focused on the photo-emissive cathode and electrons emitted therefrom are accelerated toward the control grid. The local density of the photo-emitted electrons is related to the intensity of radiation impinging upon the photo-emissive cathode. A net positive or negative charge can result from the impact of the emitted electrons on the control grid due to secondary emission. The master electrostatic replica produced on the control grid, by the impact of the photo-emitted electrons can be utilized to modulate a beam of electrons reaching the array of conductors from the electron source. The charge accumulated on the array of conductors provides an electrostatic image reproduction of the applied optical image which can be transferred to a copy sheet for electrostatographic processing.

By altering the accelerating potential between the photo-emissive cathode and the insulating material, a positive or a negative master electrostatic replica of the applied optical image can be produced.

Localized corrections to the master electrostatic replica of the control grid can be performed by a localized radiation source applied to a corresponding region of the photo-emissive cathode in conjunction with appropriate potentials applied between the photo-emissive and secondary emissive materials. Localized corrections can be achieved by bombarding the insulating material with a localized beam of electrons having an appropriate energy, the desired local increase or decrease of the stored charge of the master electrostatic replica affected through the secondary emission phenomenon.

These and other features of the invention will be understood upon reading of the following description along with the drawings.

Figure 1:
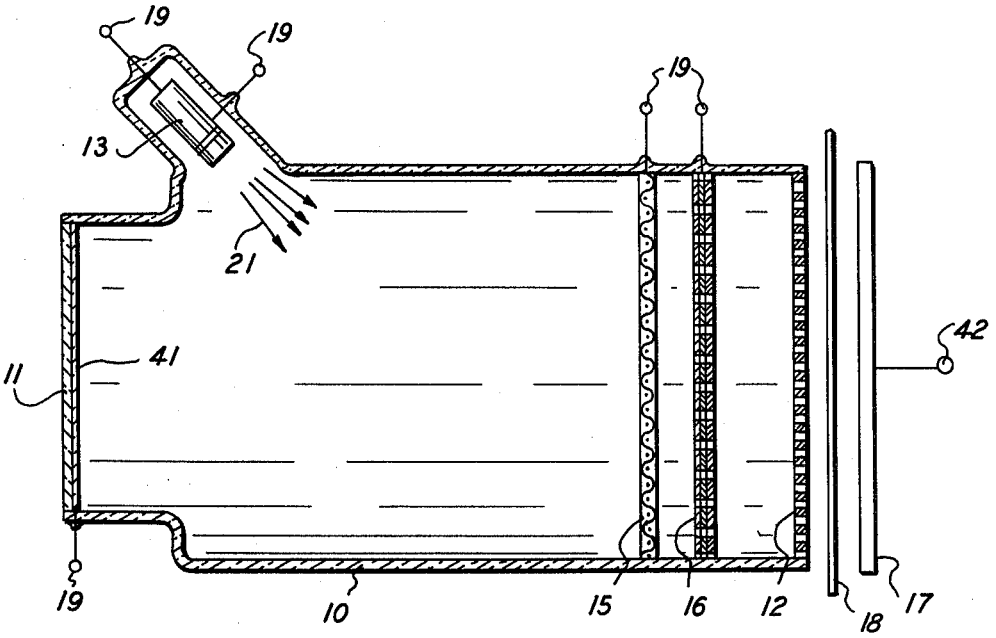
FIG. 1 is a cross-sectional view of a electrostatic image-forming device and associated apparatus according to the present invention.
Figure 2:
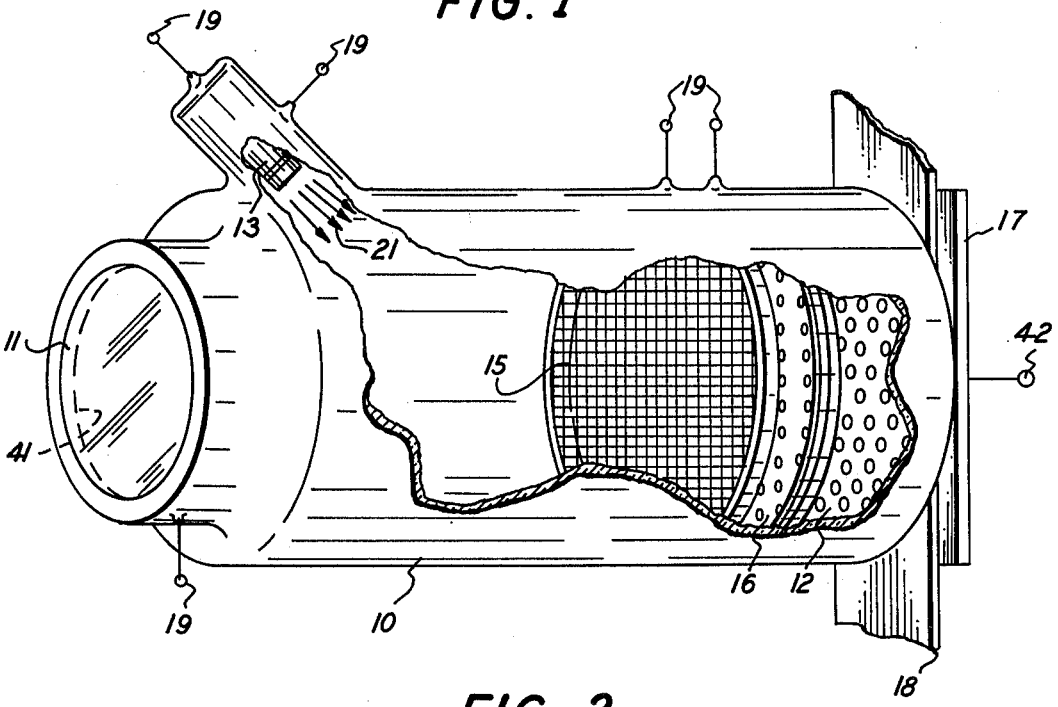
FIG. 2 is a cut-away perspective view of the electrostatic image forming device and associated apparatus according to the present invention.

Referring now to FIG. 1 and FIG. 2, a schematic cross-section and cut away perspective view of the electrostatic image forming device accordng to the present invention are shown. The electrostatic image forming device is comprised of vacuum tube device 10. One portion of the vacuum tube device 10 includes an array of conducting elements 12. The array of conducting elements electrically couples an interior region of the vacuum tube device with an exterior region of the device.

A source of electrons 13, typically, an electron gun, provides electrons designated schematically by arrows 21, propagating toward the conducting elements of array 12. Located between electron source 13 and array 12 are grid 15, and control grid 16. Grid 15 is typically comprised of conducting wire mesh and is used to minimize space charge by collecting undesired low energy electrons in the vacuum tube device. Control grid 16 is comprised of a supporting substrate, a conducting material and an insulating material suitable for secondary emisson of electrons. In the secondary emisson process, as is well known to those skilled in the art, electrons impacting in an appropriate insulating material with a predetermined velocity can on the average result in a net accumulation of electrons in the insulating material or a net decrease of the electrons (i.e. resulting in creation of a more positive charge) in the insulating material. The interior of vacuum tube device 10 is maintained at a pressure sufficiently low to provide electron trajectives for which collision with gas molecules is relatively unimportant.

Window 11 serves as an entrance into the vacuum tube device 10 for electromagnetic radiation. Located in the interior of device 10 is a photo-emissive cathode 41. A photoemissive material ejects electrons upon absorption of electromagnetic radiation of a appropriate wave-length. Imaging optics, not shown, are located entirely outside the vacuum tube device in the preferred embodiment. However, other locations for the imaging optics can be utilized when the photo-cathode is positioned away from window 11. In the preferred embodiment, the photo-cathode is comprised of a photo-emissive material deposited on an interior surface of window 11. However, other locations for the photo-cathode can be utilized. An electrode 17 is typically placed in close proximity to the exterior portion of the element array 12. Electrode 17 and array 12 form a multiplicity of capacitors upon which individual electrons can be accumulated, forming an electrostatic image. The electrostatic image can be transferred to dielectric medium 18, which passes between electrode 17 and element array 12. Terminal 42 provides a means for coupling a potential source to electrode 17.

In FIG. 1 and FIG. 2, a plurality of terminals, 19 provide electrically couple external potential sources to the apparatus positioned in the interior of the vacuum tube device 10.

The application of electromagnetic radiation of appropriate wavelength to photo-emissive material 41 results in the emission of electrons from the material. The density of emitted electrons from a local region of the photo-emissive material is determined by the intensity of the radiation absorbed by the local region. The photo-cathode 41 is maintained at a potential relative to mesh 15 and control grid 16 so that the electrons, emitted from the photo-cathode, propagate toward mesh 15 and control grid 16. The trajector followed by the photo-emitted electrons can be determined by electron optic (not shown) located between photocathode and mesh 15. In the preferred embodiment, the electric field lines are generally perpendicular to photo-cathode 41 and mesh 15. In this embodiment equipotentical plates are added to minimize fringing electric fields, however other electric field shaping elements can be utilized as will be clear to those skilled in the art.

The electrons will typically pass mesh 15 and impact upon control grid 16 producing secondary emisson electrons 23. The number of electrons produced by secondary emission can assume a value, typically designated as 8 ranging from 0 to a value greater than 1. The value of 8 will be a function of the potential difference between cathode 41 and control grid 16. The electrons produced by secondary emission are usually emitted with less velocity than the impinging electron and can, in general, be captured by grid 15. When the number of electrons produced by secondary emission is different from the number of impacting electrons, a net charge is produced either from trapped electrons or the absence of electrons stored on the insulating material 23.

Figure 3:
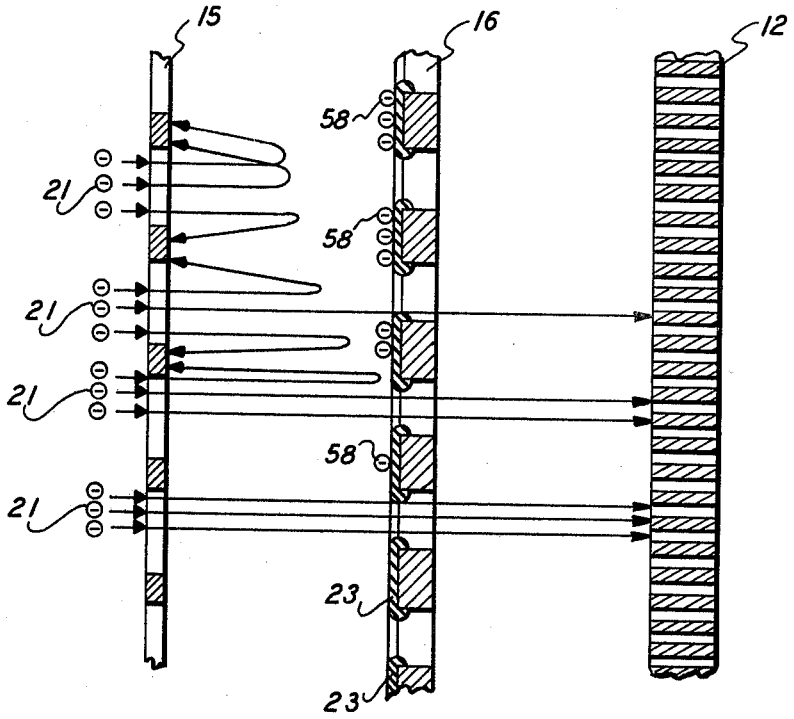
FIG. 3 is a schematic cross-sectional view illustrating the modulation of the charge stored on the control grid which determines the electrostatic image on the array of conducting elements.

Referring now to FIG. 3, a schematic cross-section of the manner in which a beam of electrons passing through apertures in control grid 16, can be used modulate the density of electrons reaching the array of conducting elements 12, the accumulation of electrons at various rates by the individual elements of array 12 resulting in an electrostatic image. The electrons provided by the electron source are indicated by arrows 21 as propagating toward the array of conductors 12. On the material 23 of electrode 16, a stored charge designated by symbols 58 is shown. The electrons 21 propagating toward array of conducting elements 12, are shown as being influenced by the number of electrons trapped on material 23 in the vicinity of the aperture at control grid 16 through which the electrons would otherwise be freely transmitted. In the region of a small charge density stored on material 23, the electrons pass through the associated apertures of electrode 16 with relatively minor deviation of the trajectory. However, as the density of stored charge associated with an aperture increases, the transmitted electrons are more frequently deflected by the stored charge and captured by grid 15.

Figure 4:
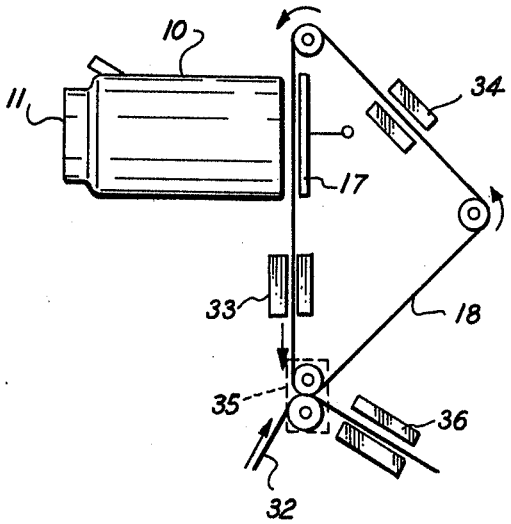
FIG. 4 is a schematic diagram of the incorporation of the electrostatic image forming device in a electrostatographic reproduction system.

Referring next to FIG. 4, a schematic diagram of electrostatographic copy system utilizing the vacuum tube device of the instant invention is shown. The optical image, not shown, is introduced into the vacuum tube device 10 through window 11. A resulting electrostatic image is produced on array 12 and can be transferred to dielectric material 18 passing between electrode 17 and array 12 vacuum tube device 10. The transfer of the electrostatic image can take place by contact transfer or by electrical breakdown. The electrostatic image produced by the device 10 can be developed at station 33 and at station 35 the developed image can be transferred to copy sheet 32. The image transferred to copy sheet 32 can be fixed at station 36. The transfer medium 18 continues past station 34, wherein the material is prepared for further transfer of electrostatic images. It will be clear to those skilled in the art that copy sheet 32 can have the electrostatic image transferred directed thereto for processing and fixing of the latent image. However, by utilizing an intermediate dielectric material 18, a material producing less abrasion with device 10 can be utilized.

The operation of the vacuum tube device 10 in forming an electrostatic replica of the applied optical image is focused on photo-cathode 41. The photo-emissive material of which the cathode 41 is comprised, produces photo-emitted electrons related to the intensity and duration of radiation falling on the localized region of the photo-emissive material. The potential between electrode 41 and control grid 16 is maintained at a value such that the emitted electrons are accelerated and collide with control grid 16. Grid 16 is comprised of an insulating material which provides secondary emission of electrons upon impact of the accelerated electrons. The electrons emitted from the insulating material of grid 16 are removed by grid 15. The electrons produced by secondary emission can, depending on the velocity of the impinging electrons, (the velocity depending on the accelerating potential between the cathode 41 and grid 16) produce a net increase in electronic charge or can produce a net decrease in electronic charge on the grid 16. Furthermore, cathode 41 and grid 16 have associated therewith appropriate electron optic apparatus so that the electrons emitted from a localized region of cathode 41 impinge on an associated localized region of control grid 16. As an example, in the preferred electric field lines be cathode 41 and grid 16 are substantially parallel, the electron optic comprised of sielding electrodes to minimize fringing electric fields. The net result is that master electrostatic image replica is produced on grid 16 for a optical image applied to cathode 41.

Furthermore, the secondary emission process in which a net negative or a net positive charge can result from the photo-emisson of electrons, permits either a positive or a negative electrostatic latent image to be formed for an applied optical image. In the preferred embodiment, preliminary to the forming of the electrostatic image on the insulating surface, the electron gun (or the electrons from the photo-cathode), can provide a uniform charge distribution on control grid 16. Thereafter, the electrostatic image formed by secondary emission on grid 16 is retained because of the electrically insulating property of the material 23.

After the master electrostatic image has been formed on the grid 16, then the source of electrons from electron source 13 is used to provide a beam of electrons passing though grid 16. The charge remaining on grid 16, in conjunction with the potential voltage differences between electron source 13 and grid 16, controls the passage of electrons through grid 16. The electrons transmitted by control grid 16 and accumulation of electrons on the members of the array of conducting elements 12 provide a pre-selected electrostatic charge distribution on the multiplicity of capacitors formed by the element array 12 and electrode 17. The electrostatic charge formed on the multiplicity of capacitors can be transferred to dielectric medium 18 and this medium can be developed by standard electrostatographic techniques. For example, referring to FIG. 4, the electrostatic image formed between vacuum tube device 10 and electrode 17 can have charged droplets of ink applied to the image region at the image developing station 33. The ink of the material 18 can be contact transferred to an appropriate, i.e. absorbent, copy sheet 32 which can be fixed at station 36 of FIG. 4. The excess ink droplets along with excess charge can be removed from the dielectric material and the pre-electrostatic image processing can be performed at station 34.

It is possible to provide, on the conductor array, a multiplicity of electrostatic replicas of the stored charge master image for transfer to the dielectric medium. However, relaxation phenomena, such as control grid charge neutralization by beam induced positive ions will eventually cause an unacceptable deterioration of the stored charge master image.

It will be further clear to those skilled in the art that the electrostatic replica provided by the charge stored on the insulating region of grid 16 can be locally corrected by one of two methods. In the first method, the electron source 13 can provide a narrow beam of electrons which are caused to impact, with preselected velocity, the desired local region of grid 16. The preselected velocity of the impinging electrons will determine whether the charge will be consequently increased or decreased in the manner described previously, thus permitting a localized correction or change in the image. In the second method, a beam of light can be focused on a localized region of cathode 41 and the electrons resulting from photo-emission can be utilized, with application of appropriate potentials between cathode 41 and control grid 16, to provide a localized change in the charge stored on the associated portion of grid 16.

It will be further clear to those skilled in the art that the apparatus of grid 15, control electrode 16 and the elements of array 12 should have apertures arranged in generally random fashion with respect to electrons from electrons source 13 to avoid undesired pattern effects from appearing in the electrostatic charge distribution of array 12. Furthermore, the electrons from source 13 can be replaced by electrons from cathode 41 although the intensity of the beam will, in general, be greatly reduced in mode of operation.

The master electrostatic image replica, stored on control grid 16, can be transferred into the conductor array 12 by a diffuse beam of electrons. In this mode of image transfer, the image is transferred comparatively slowly to the conductor array because of the diffuse electron beam. The electron beam can be more narrowly focused causing more rapid transfer of a selected portion of the master electrostatic image to the conductor array. When the selected portion of the master electrostatic image is a generally linear portion. Substantially at right angles by the motion of the dielectric medium the medium can be mantained in continuous motion synchronized with a systematic scanning by the electron beam.

The above description is included to illustrate the operation of the preferred embodiment and is not meant to limit the scope of the invention. The scope of the invention is to be limited only by the following claims. From the above discussion, many variations will be apparent to those skilled in the art that would yet be encompassed by the spirit and scope of the invention.

What is claimed is:

1. A device for forming an electrostatic charge distribution determined by an optical image comprising:

a housing including an array of conducting elements coupling an interior region with an exterior region of said housing;

a source of electrons for propagating electrons toward said array;

a grid for storing a master charge distribution; said grid being disposed between said array and said electron source, said stored master charge distribution controlling the local density of electrons reaching said array and providing said electrostatic charge distribution; and a cathode responsive to application of said optical image, to emit charged particles in a pattern correlated with said optical image onto said grid whereby to provide said stored charge distribution on said grid.

2. The device for forming an electrostatic charge distribution of claim 1 wherein:

said cathode includes a material for emitting charged paticles in response to applied electromagnetic radiation.

3. The device for forming an electrostatic charge distribution of claim 2 wherein said grid includes an insulating material and wherein said stored master charge distribution of said grid is produced by impact with said grid of charge particles emitted by said cathode.

4. The device for forming an electrostatic charge distribution of claim 1 including a means for producing a positive latent electrostatic replica of said optical image or a negative latent electrostaic replica of said optical image selectively.

5. The device for forming an electrostatic charge distribution of claim 1 further including means for controlling preselected local portion of said master charge distribution.

6. A method of forming an electrostatic latent image of an optical image, comprisng the steps of:

a. applying said optical image to a photo-emissive material;

b. utilizing electrons generated by said photo-emissive material in response to said optical image to produce a stored charge distribution on an apertured control grid related to said applied optical image;

c. controlling the density of electrons passing through individual apertures in said control grid by adjoining electrons from said stored charge distribution; and d. accumulating electrons on a multiplicity of conducting elements associated with said each aperture, said accumulated electrons producing said electrostatic latent image on said conducting element.

7. The method of forming an electrostatic latent image of claim 6 further including the step of adjusting a potential difference between said control grid and said photo-emissive material to produce one electrostatic image selected between a positive electrostatic latent image and a negative electrostatic latent image.

8. A system for producing an electrostatographic reproduction on a copy sheet of an optical image comprising:

a vacuum device for producing an electrostatic charge distribution on a multiplicity of conducting elements; said device including charge producing means for producing an image charge distribution selected from either a positive electrostatic latent image or a negative electrostatic latent image of said optical image;

a medium interposed between said charge producing means and said conducting elements for receiving said selected image charge distribution;

means for bringing a copy sheet into operative relationship with said conducting elements;

means for transferring said selected image charge distribution to said conducting elements and said copy sheet;

means for developing the charge distribution on said copy sheet; and means for fixing the developed charge distribution on said copy sheet.

9. Apparatus for producing an electrostatic charge distribution determined by an optical image, comprising:

means for producing and propagating electrons;

a housing containing said electron producing means, said housing being evacuated to provide generally collisionless trajectories to said electrons;

means for accumulating electrons propagated by said electron producing means; and means for controlling the density of electrons propagated toward said accumulation means from said electron producing means in response to said optical image whereby to provide a charge distribution on said accumulating means correlated with said optical image.

10. The apparatus for providing an electrostatic charge distribution of claim 9 including means for regulating the charge distribution on said accumulating means to provide either a positive or a negative reproduction of said optical image selectively.

11. The apparatus for producing an electrostatic charge distribution of claim 10 wherein said charge distribution regulating means includes a photo-emissive material.

12. The apparatus for producing an electrostaic charge distribution of claim 9 in which said controlling means includes means for controlling density of said electrons on said accumulating means on a preselected local portion of said accumulating means.

13. An improved device for producing an electrostatic charge distribution replica of an optical image of the type having a multiplicity of conducting elements for accumulating electrons and a source of electrons for supplying said electrons to said elements, the improvement comprising:

a control grid for controlling a density of electrons reaching each of said elements, said control grid including means for mantaining a charge distribution; and a cathode responsive to said optical image for determining said control grid chage distribution.

14. The improved device of claim 13 wherein said cathode includes a photo-emissive material for producing said charge distribution in response to said optical image.

* * * * *